US007980100B2

(12) United States Patent
Lonati et al.

(10) Patent No.: US 7,980,100 B2
(45) Date of Patent: Jul. 19, 2011

(54) HIGHLY RELIABLE SINKERLESS KNITTING MACHINE WITH LATCH NEEDLES

(75) Inventors: Ettore Lonati, Botticino (IT); Tiberio Lonati, Brescia (IT); Fausto Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/600,312

(22) PCT Filed: Mar. 27, 2008

(86) PCT No.: PCT/EP2008/053691

§ 371 (c)(1), (2), (4) Date: Nov. 16, 2009

(87) PCT Pub. No.: WO2008/145433

PCT Pub. Date: Dec. 4, 2008

(65) Prior Publication Data

US 2010/0175428 A1 Jul. 15, 2010

(30) Foreign Application Priority Data

May 30, 2007 (IT) ..... MI2007A1098

(51) Int. Cl.
*D04B 15/06* (2006.01)

(52) U.S. Cl. ..... 66/106

(58) Field of Classification Search ..... 66/104, 66/106, 109, 91, 92, 93
See application file for complete search history.

(56) References Cited

U.S. PATENT DOCUMENTS

| | | | | |
|---|---|---|---|---|
| 3,643,472 | A * | 2/1972 | Apprich | 66/106 |
| 3,754,416 | A * | 8/1973 | Apprich | 66/106 |
| 4,576,018 | A * | 3/1986 | Schindele | 66/106 |
| 4,608,841 | A * | 9/1986 | Buck et al. | 66/104 |
| 4,693,092 | A * | 9/1987 | Plath | 66/55 |
| 4,741,181 | A * | 5/1988 | Plath | 66/104 |
| 4,751,829 | A * | 6/1988 | Plath | 66/13 |
| 5,163,305 | A | 11/1992 | Tenconi | |
| 6,401,495 | B2 * | 6/2002 | Eppler et al. | 66/106 |

FOREIGN PATENT DOCUMENTS

| | | | |
|---|---|---|---|
| CN | 1800466 | A | 7/2006 |
| DE | 198 20 042 | A1 | 11/1999 |
| EP | 0 421 242 | A2 | 4/1991 |
| EP | 0 683 257 | A1 | 11/1995 |
| WO | WO 2008/003463 | A1 | 1/2008 |

OTHER PUBLICATIONS

EPO communication letter regarding "observations by a third party concerning the patentability" dated Jul. 20, 2010.

* cited by examiner

*Primary Examiner* — Danny Worrell
(74) *Attorney, Agent, or Firm* — Scully, Scott, Murphy & Presser, P.C.

(57) ABSTRACT

A sinkerless knitting machine with latch needles, comprising a needle holder with a plurality of slots on one face, each slot accommodating a needle. Knitting retainers are provided, each with a body composed of at least two side-by-side interconnected laminar elements. At least two laminar elements of each knitting retainer are arranged in a same or in two contiguous slots of the needle holder. At least one of the laminar elements composing a knitting retainer has a retention portion defining a stop shoulder for the knitting. Each knitting retainer can move on command from a first position, in which it does not interfere with the knitting being formed, to a second position, in which it is inserted, with the retention portion, between two contiguous needles, in a region which faces the knitting forming plane, in order to retain the portion of knitting that lies between two contiguous needles.

19 Claims, 11 Drawing Sheets

HIGHLY RELIABLE SINKERLESS KNITTING MACHINE WITH LATCH NEEDLES

TECHNICAL FIELD

The present invention relates to a highly reliable knitting machine with latch needles.

BACKGROUND ART

As is known, knitting machines with latch needles are generally equipped with sinkers which co-operate with the needles in forming knitting.

More particularly, sinkers perform the function of defining a knitting forming plane on which the portion of knitting arranged between two contiguous needles rests while such needles, after picking up the yarn at a feed or drop of the machine, retract into the needle holder in order to form a new loop of knitting and to lower the previously formed loop of knitting and of tensioning the loop of knitting on the shank of the needle while said needle is extracted with its tip and with part of its shank from the needle holder of the machine in order to pick up the yarn dispensed at a feed or drop of the machine and form a new loop of knitting. The engagement of the sinkers with the knitting that tensions the loop of knitting on the shank of the needle, in this step, also prevents the loop of knitting from following the needle in its extraction movement and assuredly achieves the opening of the latch and the passage of the loop of knitting below the latch. The tensioning of the loop of knitting on the shank of the needle by the sinkers is generally assisted by traction of the already-formed knitted fabric, which is performed generally by means of pneumatic traction devices in small-diameter circular machines and by means of mechanical devices in other machines.

The sinkers are usually accommodated in appropriately provided slots defined, at the end of the needle holder from which the needles protrude in order to pick up the yarn at a feed or drop of the machine, directly in the needle holder or in a supporting element which is fixed to the needle holder. The sinkers are generally actuated by means of appropriately provided cams, which face the region of the needle holder that accommodates the sinkers and form paths which can be engaged by heels of the sinkers, which protrude from the needle holder, as a consequence of a movement of the needle holder with respect to the cams.

In many types of fine-gauge knitting machines, in which the space between the needles is very small, the sinkers are absent.

In these machines, the absence of the sinkers, imposed by space occupation requirements, is the source of problems and drawbacks. The absence of the sinkers, during accidental breakage of the yarn being knitted, in fact prevents automatic resumption of the formation of knitting and forces manual intervention in order to unload the new loops of knitting onto the shank of the needles which, as a consequence of the breakage of the yarn, have lost the knitting.

Moreover, due to the fact that in these machines the tensioning of the loops of knitting on the shank of the needles while such needles are extracted with their tip from the needle holder to pick up the yarn at a feed or drop of the machine is performed exclusively by the fabric traction device, such tensioning can be insufficient, also due to the large number of needles engaged with the knitting, to ensure the passage of the loops of knitting below the latch of the needles while the needles are extracted from the needle holder, causing knitting errors.

In order to limit these problems, in some cases these machines are actuated by moving to knit in each instance, at a feed or drop of the machine, only one needle every two contiguous needles, so that the needle that is not used to form knitting performs a retaining action on the loops of knitting formed by the contiguous needles that are moved to knit. This refinement, however, suffers the drawback of not allowing to exploit fully the production potential of the machine.

In order to solve these problems, it has been proposed to provide machines with knitting retainers which are arranged in the slots of the needle holder laterally to the corresponding needle and are provided with a portion which protrudes beyond the knitting forming plane. These knitting retainers can be actuated in order to engage, between two contiguous needles, the loop linking portion, so as to retain it as an alternative to the sinkers.

However, this refinement can be adopted only in reduced-gauge machines, since in fine-gauge machines, due to space occupation reasons, the knitting retainers would have to be so thin as to be exposed to easy deformations during operation, which would compromise their integrity and reliability.

DISCLOSURE OF THE INVENTION

The aim of the present invention is to provide a knitting machine with latch needles which ensures high reliability in operation with correct formation of the knitting without imposing a limitation of the active needles and thus allowing to exploit fully its productive potential.

Within this aim, an object of the invention is to provide a knitting machine which ensures high reliability and precision in operation even if it has a very fine gauge.

Another object of the invention is to provide a machine which allows automatic resumption of knitting even in case of accidental loss of the yarn by the needles.

This aim and these and other objects, which will become better apparent hereinafter, are achieved by a knitting machine with latch needles, comprising a needle holder having on one face thereof a plurality of side-by-side slots which are open at one of their longitudinal ends on one side of the needle holder that defines the knitting forming plane, each slot accommodating a needle actuatable with reciprocating motion along the corresponding slot composed of extraction and retraction motion, the extraction motion for extracting the needle with its tip and with a portion of its shank from the needle holder through said longitudinal end of the corresponding slot in order to unload onto its shank the loop of knitting formed previously and/or to take up the yarn or yarns dispensed at a feed or drop of the machine, and the retracting motion for retracting the needle with its tip into the corresponding slot in order to form a new loop of knitting, lowering the previously formed loop of knitting to form knitting, characterized in that it further comprises knitting retainers, each of which has a body which is composed of at least two side-by-side laminar elements which are connected to each other, said at least two laminar elements of each knitting retainer being arranged in a same slot or in two contiguous slots of said slots, at least one of the laminar elements that compose a knitting retainer having a retention portion which forms a stop shoulder for the knitting, each knitting retainer being movable on command from a first position, in which the retainer does not interfere with the knitting being formed, to a second position, in which the retainer is inserted, with said retention portion, between two contiguous needles, in a region which faces said knitting forming plane, in order to retain the portion of knitting that lies between two contiguous needles, contrasting the transfer of the knitting along the needles during the extraction motion of said needles, actuation means being provided for actuating said knitting retainers for their transition from said first position to said second position and vice versa in a manner which is coordinated with the actuation of the contiguous needles.

BRIEF DESCRIPTION OF THE DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a schematic perspective view of a portion of the machine according to the invention, with some elements omitted for the sake of greater clarity and illustrating a needle, a knitting retainer composed of two laminar elements, and the corresponding actuation means in an exploded view;

FIG. 2 is a schematic perspective view of a portion of the machine according to the invention, with some elements omitted for the sake of greater clarity, in a manner similar to FIG. 1, and with a knitting retainer in the first position;

FIG. 3 is a schematic sectional view of a portion of the machine according to the invention, taken along a central plane which is parallel to the side walls of a slot of the needle holder in which a needle is accommodated with a knitting retainer in the first position;

FIG. 4 is an enlarged-scale schematic sectional view of FIG. 3, taken along the line IV-IV, with the means for actuating the knitting retainers omitted;

FIG. 5 is a sectional view of a portion of the machine according to the invention, taken in a manner similar to FIG. 3, with a knitting retainer in the second position;

FIG. 6 is a schematic perspective view of a portion of the machine according to the invention, with some elements omitted for the sake of greater clarity and illustrating a needle, a knitting retainer composed of two laminar elements, and the corresponding actuation means in an exploded view;

FIG. 7 is a schematic perspective view of a portion of the machine according to the invention, with some elements omitted for the sake of greater clarity, in a manner similar to FIG. 6, and with a knitting retainer in the first position;

FIG. 8 is a schematic sectional view of a portion of the machine according to the invention, taken along a central plane which is parallel to the side walls of a slot of the needle holder in which a needle is accommodated, with a knitting retainer in the first position;

FIG. 9 is a schematic enlarged-scale sectional view of FIG. 8, taken along the line IX-IX, with the knitting retainer actuation means omitted;

FIG. 10 is a sectional view of a portion of the machine according to the invention, taken in a manner similar to FIG. 8, with a knitting retainer in the second position;

Figure 1:
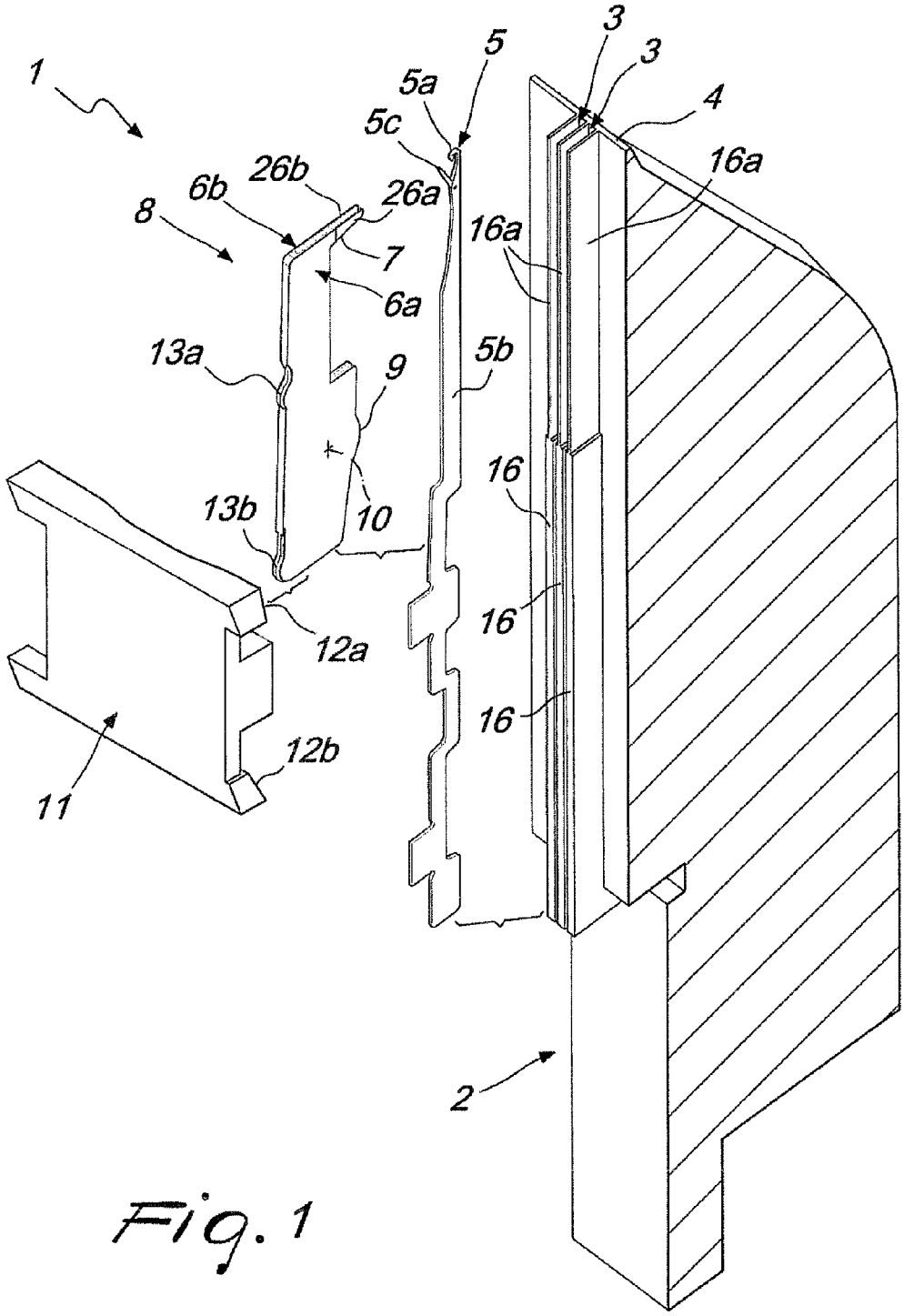
FIGS. 1 to 5 are views of the machine in a first embodiment, more particularly.
Figure 2:
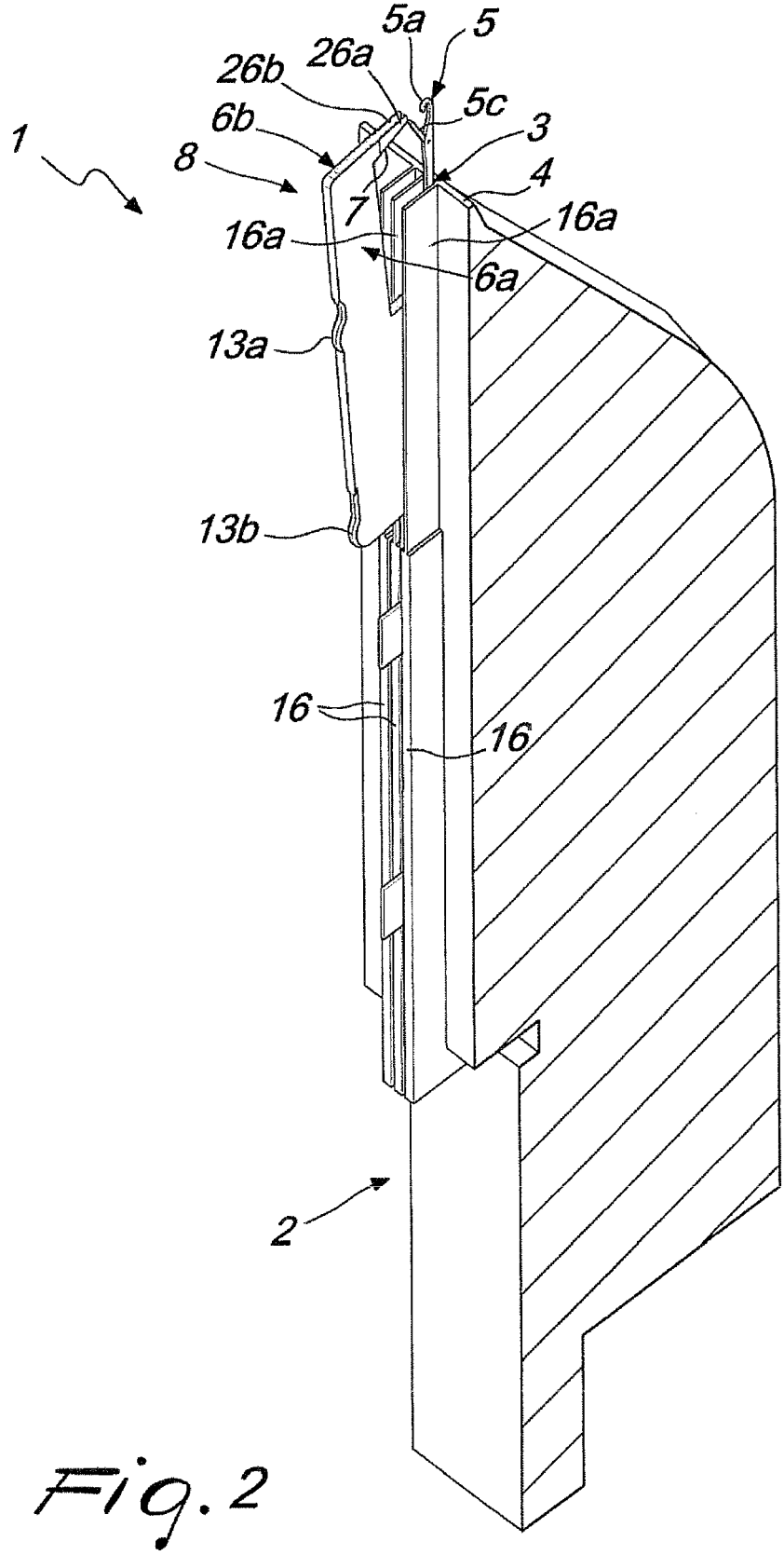
Figure 3:
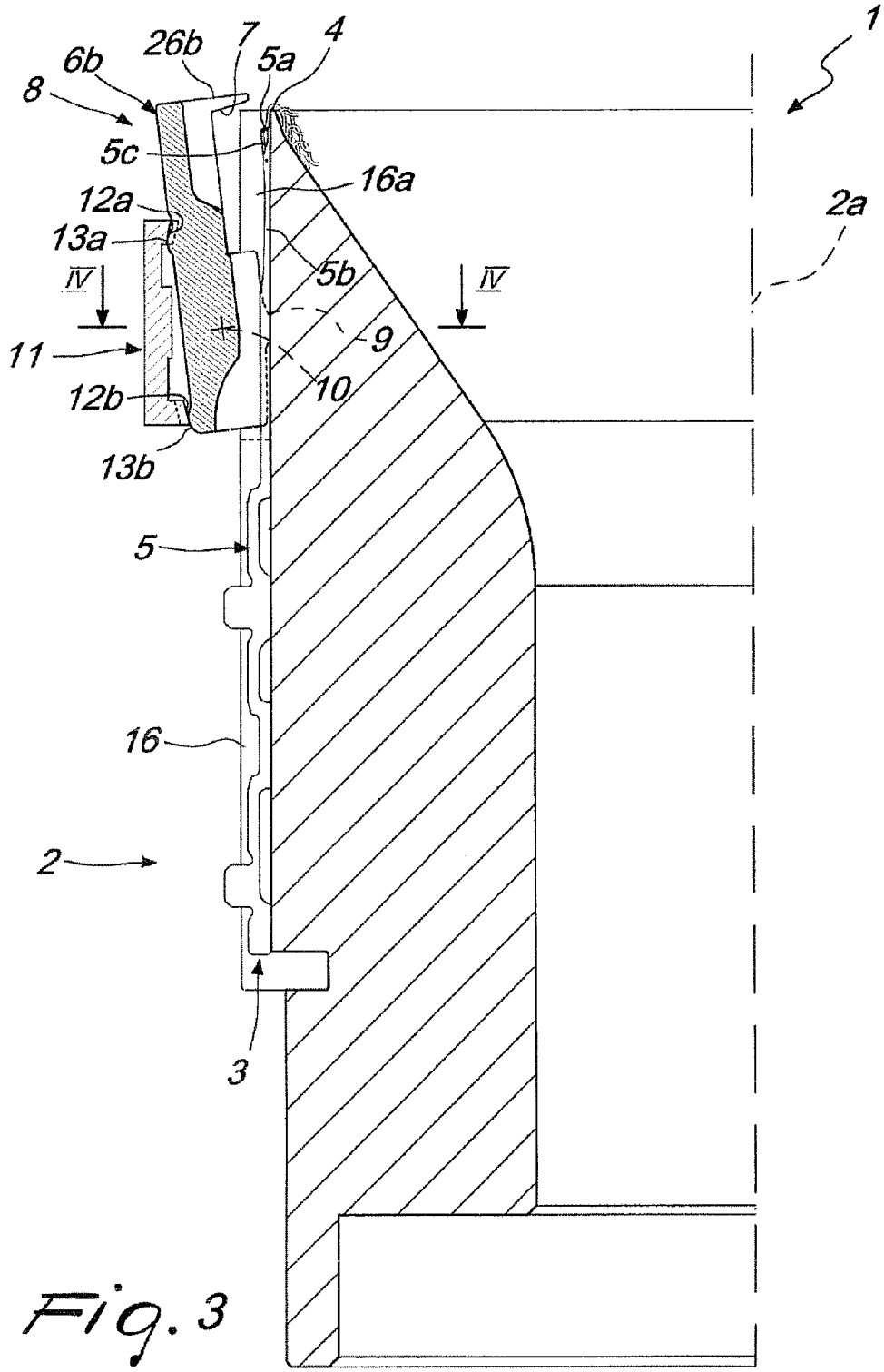
Figure 4:
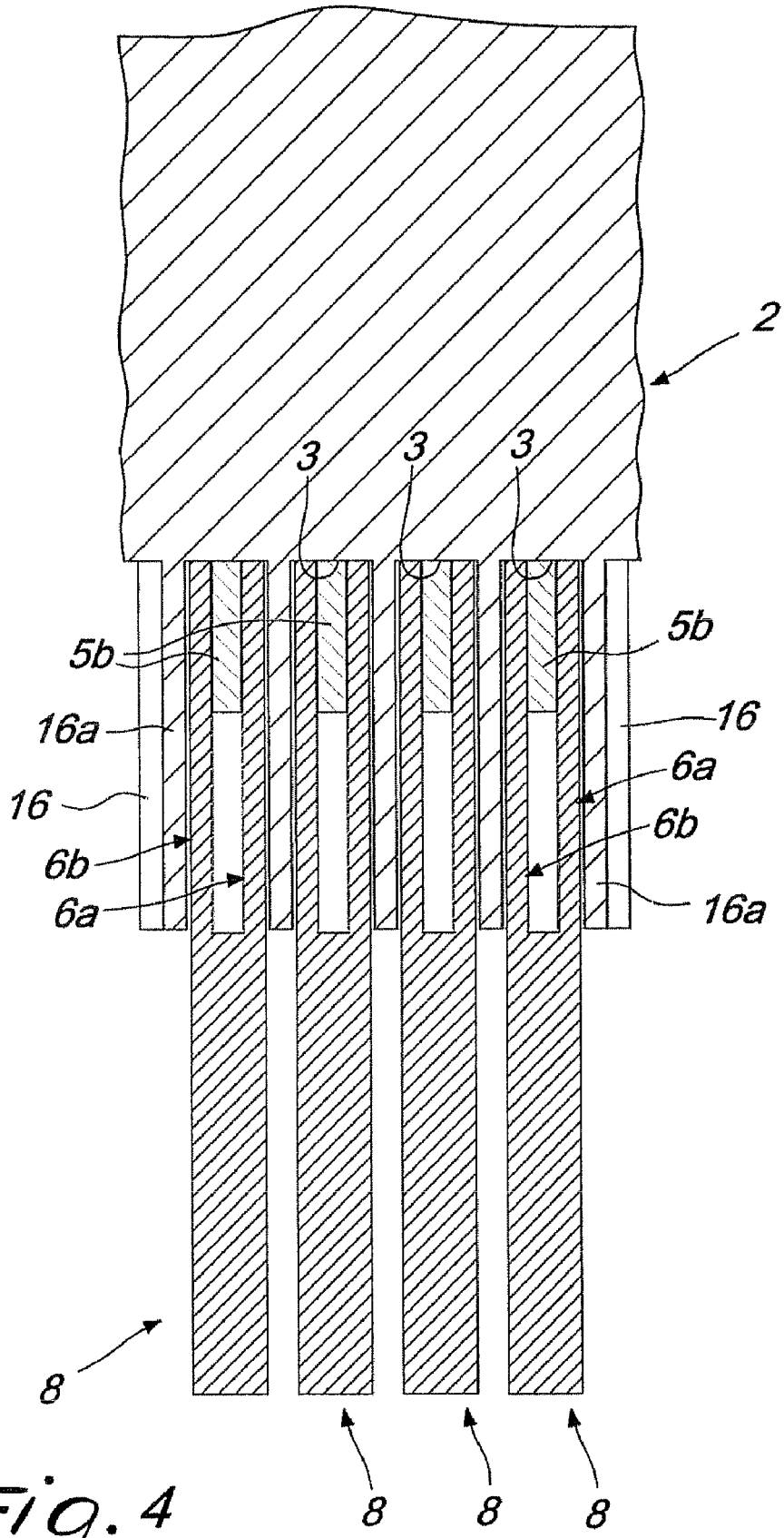

The embodiments shown in the cited figures relate to a single-bed circular knitting machine, but the solution according to the invention can be adopted also in double-bed circular knitting machines and in straight knitting machines.

WAYS OF CARRYING OUT THE INVENTION

With reference to the figures, the knitting machine with latch needles according to the invention, generally designated in the two embodiments by the reference numerals 1 and 1*a* and shown only partially for the sake of simplicity, comprises a needle holder 2, on one face of which there is a plurality of side-by-side slots 3, which are open at one of their longitudinal ends on one side of the needle holder 2 which defines a knitting forming plane 4, i.e., the plane on which the loop linking portions rest during the formation of the loops of knitting, as will become better apparent hereinafter.

A needle 5 is arranged in each of the slots 3 and can be actuated, in a per se known manner, along the corresponding slot 3 with a reciprocating motion composed of an extraction motion, by means of which the needle 5 is extracted with its tip 5*a* and with a portion of its shank 5*b* from the longitudinal end of the slot 3 defined in the knitting forming plane 4 in order to unload, onto its shank 5*b*, the loop of knitting formed previously and/or to take the yarn or yarns dispensed at a feed or drop of the machine, and of a retracting motion, by means of which the needle 5 retracts with its tip 5*a* into the slot 3, thus forming a new loop of knitting and lowering the loop of knitting formed previously in order to form knitting.

According to the invention, the machine comprises knitting retainers 8, which have a body composed of at least two side-by-side laminar elements 6*a*, 6*b* connected to each other. The at least two laminar elements 6*a*, 6*b* that compose a same knitting retainer 8 can be connected to each other by monolithic provision, as shown, or by welding, or by means of rivets or pins, so as to be preferably rigidly coupled to each other.

The at least two laminar elements 6*a*, 6*b* that compose a same knitting retainer 8 can be arranged in a same slot 3 of the needle holder 2, as shown in FIGS. 1 to 5 with reference to the first embodiment, or can be arranged so that one is in one slot 3 and one is in the contiguous slot 3, as shown in FIGS. 6 to 10 with reference to the second embodiment.

At least one of the laminar elements 6*a*, 6*b* that compose a knitting retainer 8 has a retention portion 26*a*, 26*b* which defines a stop shoulder 7 for the knitting and the retainer 8 can move on command from a first position, in which it does not interfere with the knitting being formed, to a second position, in which it is inserted, with the retention portion 26*a*, 26*b*, between two contiguous needles 5, in the region that faces the knitting forming plane 4 in order to retain, by means of the stop shoulder 7, the portion of the knitting that lies between two contiguous needles 5 so as to contrast the traction of the knitting by the needles 5 during their extraction motion. The machine is provided with actuation means for actuating the knitting retainers 8 in order to actuate their transition from the first position to the second position and vice versa in a manner which is coordinated with the actuation of the contiguous needles 5.

The slots 3, inside each of which a needle 5 slides, can be delimited laterally by laminas which are inserted, in a per se known manner, in slits defined in the body of the needle holder 2 or, as shown, by fins 16 which are provided monolithically with the body of the needle holder 2.

For the sake of simplicity and greater clarity, FIGS. 1, 2, 6 and 7 illustrate only three fins 16, but nevertheless laminas or fins 16 are distributed over the entire face of the needle holder 2 in order to define the slots 3 in a per se known manner.

Preferably, each of the slots 3 accommodates at least one laminar element 6*a* or 6*b* of a knitting retainer 8 and even more preferably each slot 3 accommodates two laminar elements 6*a*, 6*b* which belong to a same knitting retainer 8, as shown in FIGS. 1 to 5, or to two contiguous knitting retainers 8, as shown in FIGS. 6 to 10.

More particularly, each laminar element 6*a*, 6*b* lies on a plane which is parallel to the side walls of the slot 3 in which it is arranged, i.e., substantially at right angles to the face of the needle holder 2 in which the slots 3 are defined. If the needle holder 2 is constituted by a cylinder, i.e., if the machine is a circular knitting machine, each laminar element 6*a*, 6*b* is arranged on a radial plane of the cylinder, i.e., a plane which passes through the axis 2*a* of the cylinder.

The retention portion 26*a*, 26*b* is defined by a longitudinal end of at least one of the laminar elements 6*a*, 6*b* that compose a knitting retainer 8 and such retention portion 26*a*, 26*b* protrudes beyond the knitting forming plane 4 and toward the needle holder 2 in order to define, with its side directed toward the knitting forming plane 4, the stop shoulder 7.

Preferably, each of the laminar elements 6*a*, 6*b* has its own retention portion 26*a*, 26*b*, which defines the stop shoulder 7.

Each knitting retainer 8 is composed preferably of two laminar elements 6*a*, 6*b*.

In the first embodiment, shown in FIGS. 1 to 5, each knitting retainer 8 is composed of two laminar elements 6*a*, 6*b*, which are arranged in a same slot 3, laterally and on mutually opposite sides with respect to the needle 5 accommodated in the slot 3, and the knitting retainer 8, composed of said laminar elements 6*a*, 6*b*, is arranged astride such needle 5.

In the second embodiment, shown in FIGS. 6 to 10, each knitting retainer 8 is composed of two laminar elements 6*a*, 6*b* arranged in two contiguous slots 3, and the knitting retainer 8, composed of such laminar elements 6*a*, 6*b*, straddles the portion of the needle holder 2 that is arranged between these two contiguous slots 3.

In both of the illustrated embodiments, the fins 16, which delimit laterally two contiguous slots 3, have at the laminar elements 6*a*, 6*b* of the knitting retainers 8, a region 16*a* with reduced thickness which allows to increase the thickness of the laminar elements 6*a*, 6*b* of the knitting retainers 8.

Optionally, in order to further increase the deformation resistance of the knitting retainers 8, it is possible to mutually connect even two or more contiguous knitting retainers 8. This connection can be performed in a manner similar to the connection between the laminar elements 6*a*, 6*b* that compose each knitting retainer 8.

Each knitting retainer 8 can oscillate, on a plane which is substantially perpendicular to the face of the needle holder 2 in which the slots 3 are defined, with respect to the needle holder 2, in order to pass from the first position to the second position cited above and vice versa.

More particularly, each laminar element 6*a*, 6*b* that composes a knitting retainer 8 has, on its side directed toward the needle holder 2, an intermediate portion 9, which is preferably shaped like a circular sector and rests on the bottom of the slot 3 in which it is accommodated. This intermediate portion 9 defines an axis 10 for the oscillation of the laminar element 6*a*, 6*b* with respect to the needle holder 2. The oscillation axis 10 is oriented substantially at right angles to the plane of arrangement of the corresponding laminar element 6*a*, 6*b*, which can oscillate, together with the at least one laminar element 6*a*, 6*b* to which it is connected, about such oscillation axis 10 with respect to the needle holder 2 in order to perform the transition of the corresponding knitting retainer 8 from the first position to the second position or vice versa.

In view of the mutual proximity of the laminar elements 6*a*, 6*b* that compose a same knitting retainer 8, the oscillation axes 10 of the laminar elements 6*a*, 6*b* that compose a knitting retainer 8 practically coincide and constitute a single oscillation axis for the corresponding knitting retainer 8.

In both of the illustrated embodiments, since there are two laminar elements 6*a*, 6*b* and each of said laminar elements is provided with a corresponding retention portion 26*a*, 26*b*, there are two retention portions 26*a*, 26*b* between two contiguous needles 5. This preferred embodiment of the knitting retainers 8 can be used advantageously in double-bed machines, since the longitudinal ends of two laminar elements 6*a*, 6*b* which protrude beyond the knitting forming plane 4 between two contiguous needles 5, when the corresponding knitting retainer or retainers 8 is or are in the second position cited above, define between them a passage for a needle which belongs to the other bed of the machine.

Thanks to the fact that the knitting retainers 8 are composed of at least two laminar elements 6*a*, 6*b* connected to each other, each resting on the bottom of a slot 3 of the needle holder 2, a high resistance to deformation during use is achieved for the knitting retainers 8. This resistance can be increased further by connecting two or more knitting retainers 8 to each other.

It should be noted that the particular embodiment of the knitting retainers 8 and the connection of two or more knitting retainers 8 to each other achieve a greater resistance to deformation of these elements, which is particularly useful in the case of fine-gauge machines, in which the thickness of an individual laminar element or knitting retainer 8 would indeed be so small as to expose these elements to easy deformations.

The actuation means for actuating the knitting retainer 8 in order to produce its transition from the first position to the second position or vice versa comprise at least one actuation cam 11, which faces the face of the needle holder 2 in which the slots 3 are provided. The needle holder 2 can be actuated, along an actuation direction which is substantially perpendicular to the longitudinal extension of the slots 3, with respect to the actuation cam 11, and the actuation cam 11 has a profile 12*a*, 12*b* which is contoured so as to act alternately on the knitting retainer 8 formed by at least two laminar elements 6*a*, 6*b* in two regions 13*a*, 13*b* which are located on mutually opposite sides with respect to the oscillation axis 10, in order to produce the oscillation of the knitting retainer 8, and therefore of the laminar elements 6*a*, 6*b* that compose it, about the oscillation axes 10 with respect to the needle holder 2 in one direction or in the opposite direction for their transition from the first position to the second position or vice versa.

In the illustrated embodiments there is a single actuation cam 11 with a double profile 12*a*, 12*b*, but there can be two separate actuation cams, each with a corresponding profile 12*a*, 12*b* which acts respectively on the region 13*a* or on the region 13*b* of the knitting retainer 8 composed of at least two laminar elements 6*a*, 6*b*.

The profiles 12*a*, 12*b* are contoured so as to move progressively toward and away from the needle holder 2 in accordance with the actuation direction of the needle holder 2 with respect to the actuation cam or cams 11. More particularly, the profile 12*a* has a portion which progressively approaches the needle holder 2 at a portion of the profile 12*b* that progressively moves away from the needle holder 2 and a portion which progressively moves away from the needle holder 2 at a portion of the profile 12*b* that progressively approaches the needle holder 2 so that the profile 12*a* produces the oscillation of the knitting retainer 8, which is composed of at least two laminar elements 6*a*, 6*b*, about the oscillation axes 10 for its transition from the first position to the second position while the profile 12*b* allows this oscillation and so that the profile 12*b* causes the oscillation of the knitting retainer 8, composed of at least two laminar elements 6*a*, 6*b*, about the oscillation axes 10 for its transition from the second position to the first position, while the profile 12*a* allows this oscillation.

Although in order to achieve optimum knitting retention it is preferred to have all the slots 3 of the needle holder 2 occupied by two laminar elements 6*a*, 6*b* with a corresponding retention portion 26*a*, 26*b*, i.e., to have two retention portions 26*a*, 26*b* between two contiguous needles 5, it is also possible to provide only one of the laminar elements that compose a knitting retainer 8 with the retention portion 26*a*, 26*b* and/or to limit the presence of the laminar elements 6*a*, 6*b* and therefore of the knitting retainers 8 to only some of the slots 3, i.e., providing a knitting retainer 8 every two slots 3, or every three slots 3 or more, according to the requirements and to the gauge of the machine.

Preferably, the machine according to the invention is constituted by a single-cylinder circular knitting machine, as shown, and the needle holder 2 is constituted by a cylinder which has a vertical axis 2*a*, or needle cylinder, with the slots 3 defined on its lateral surface and oriented parallel to its axis 2*a*. In this case, the needle holder 2 can be actuated with a rotary motion about its own axis 2*a* with respect to the actuation cam 11.

Preferably, the machine according to the invention has a gauge which substantially ranges from 32 to 60 needles per inch.

Operation of the machine according to the invention as regards the knitting retainers 8 is as follows.

During the production of knitting, the needles 5 are cyclically extracted with their tip 5*a* and with part of their shank 5*b* from the corresponding slot 3 so as to unload onto their shank 5*b*, below the latch 5*c*, the previously formed loops of knitting and/or pick up the yarn or yarns dispensed at a feed or drop of the machine and are then made to retract into the corresponding slot 3 so as to form new loops of knitting while the portion of knitting that mutually connects the loops of knitting being formed rests on the knitting forming plane 4. During the movement for the retraction of the needles 5 into the slots 3, the knitting retainers 8 arranged in the regions of the needle holder 2 located between the slots 3 are kept in the first position by the action of the profile 12*b* of the actuation cam 11 on the region 13*b*, so as to not interfere with the knitting being formed, as shown in FIGS. 2, 3, 7 and 8.

Figure 5:
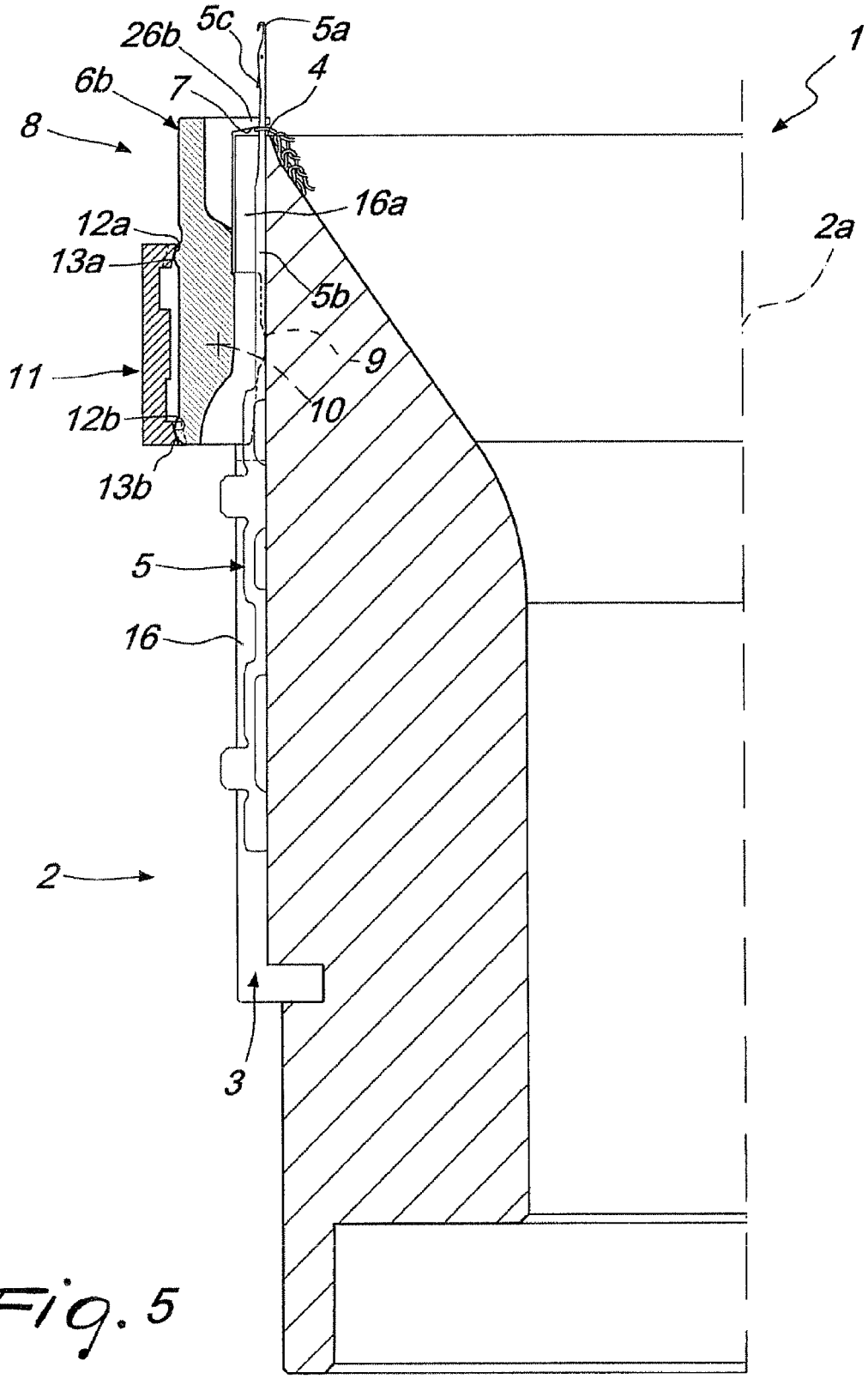
Figure 6:
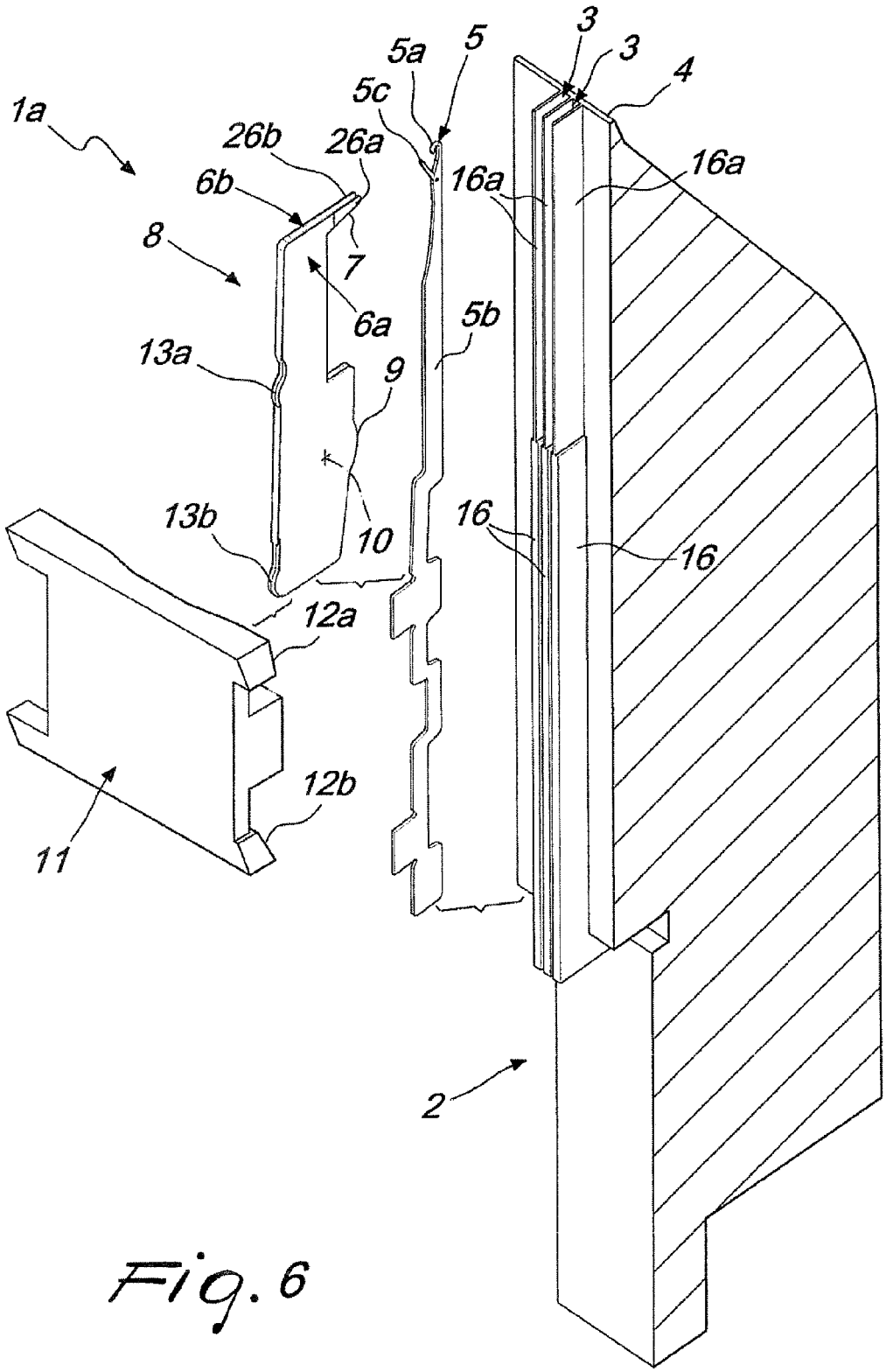
FIGS. 6 to 10 are views of the machine in a second embodiment, more particularly.
Figure 7:
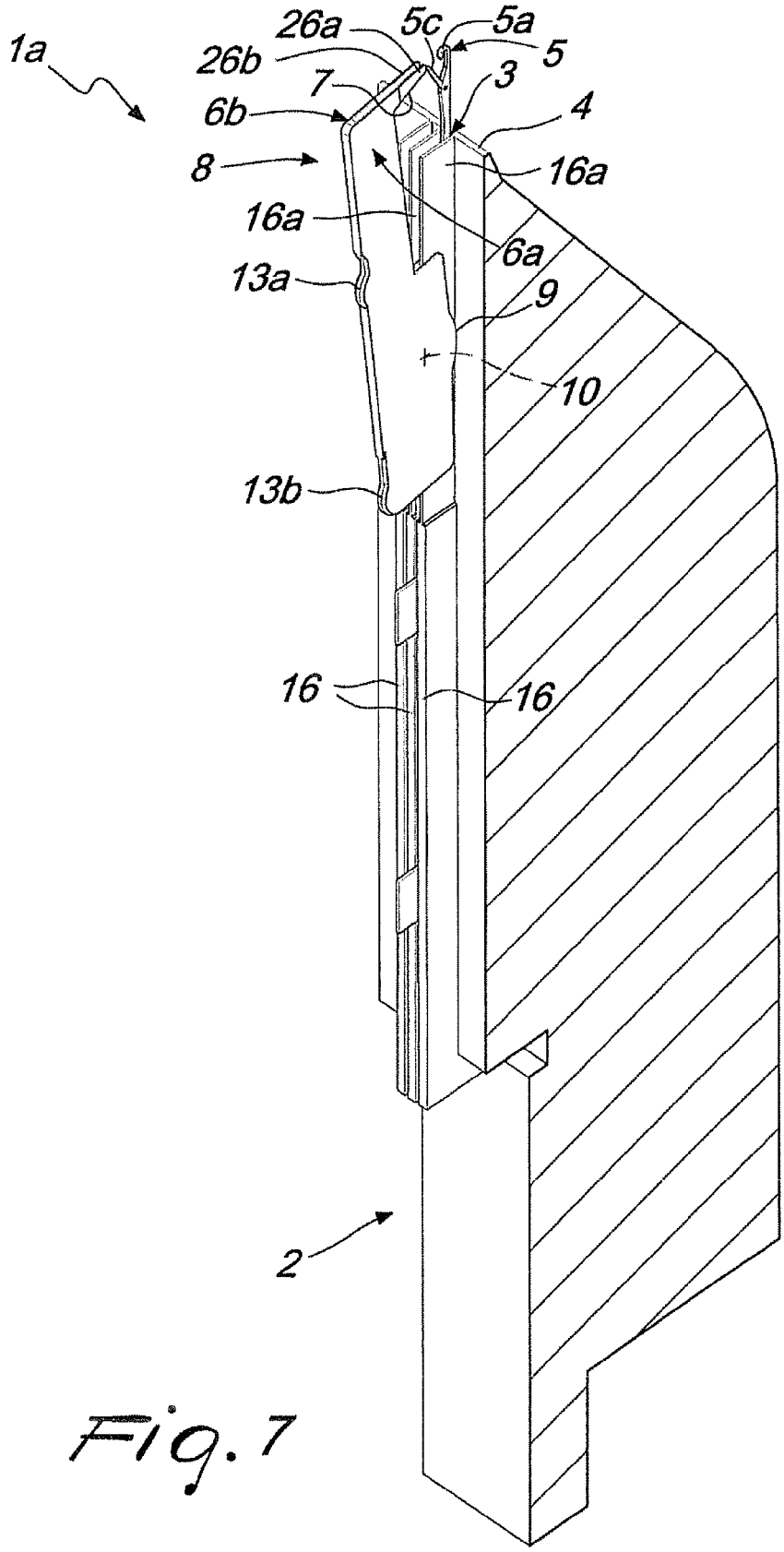
Figure 8:
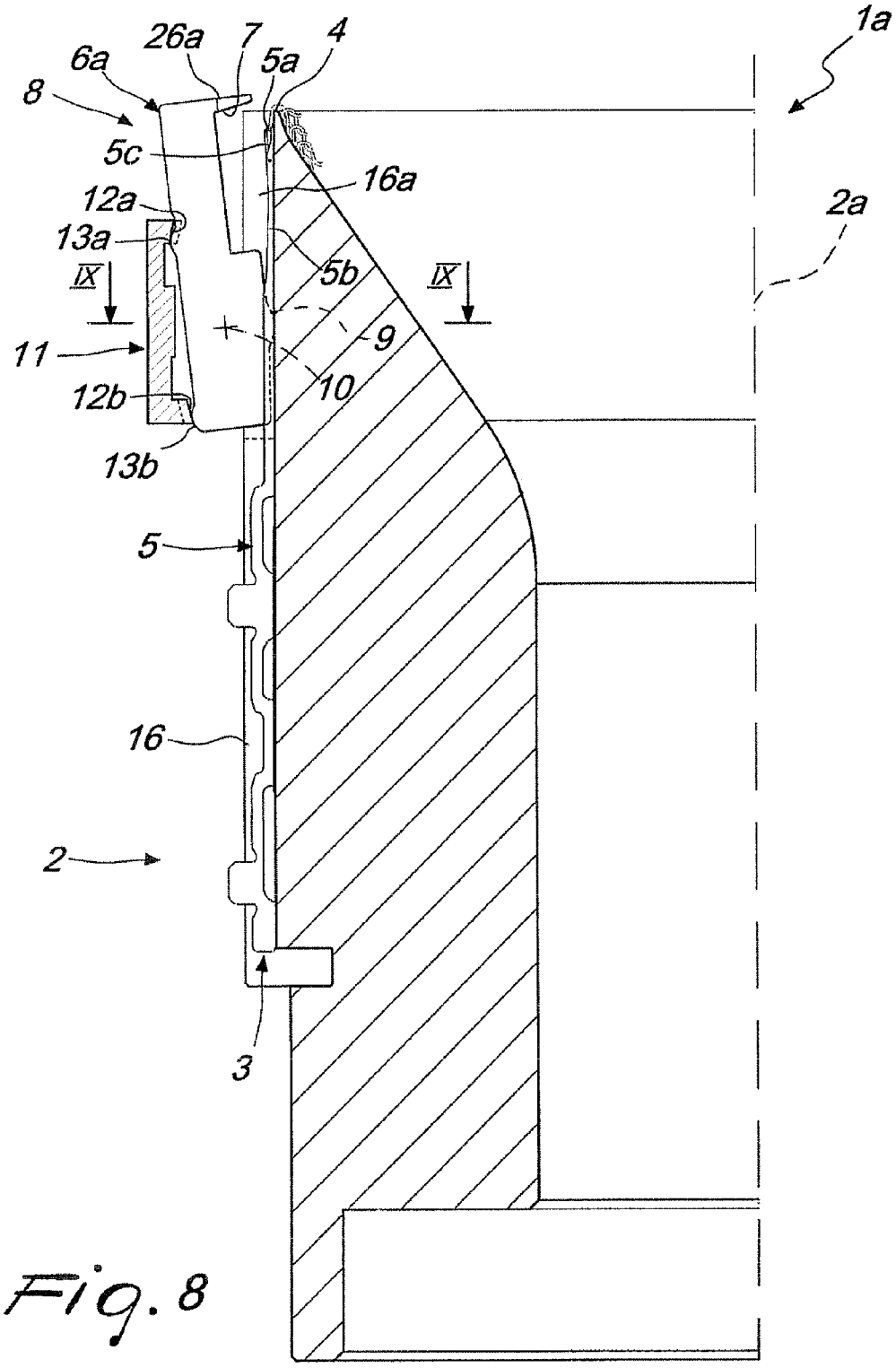
Figure 9:
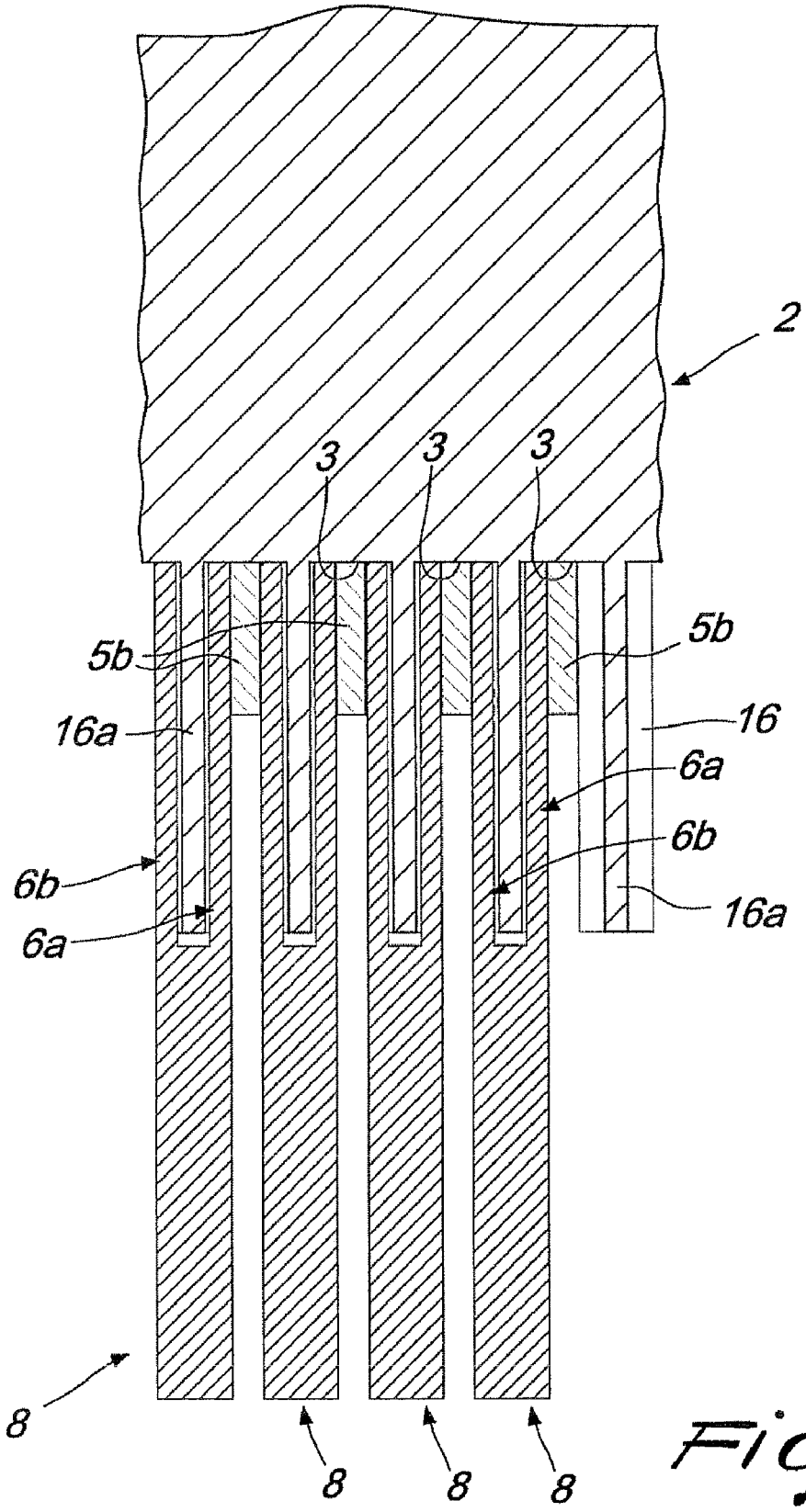
Figure 10:
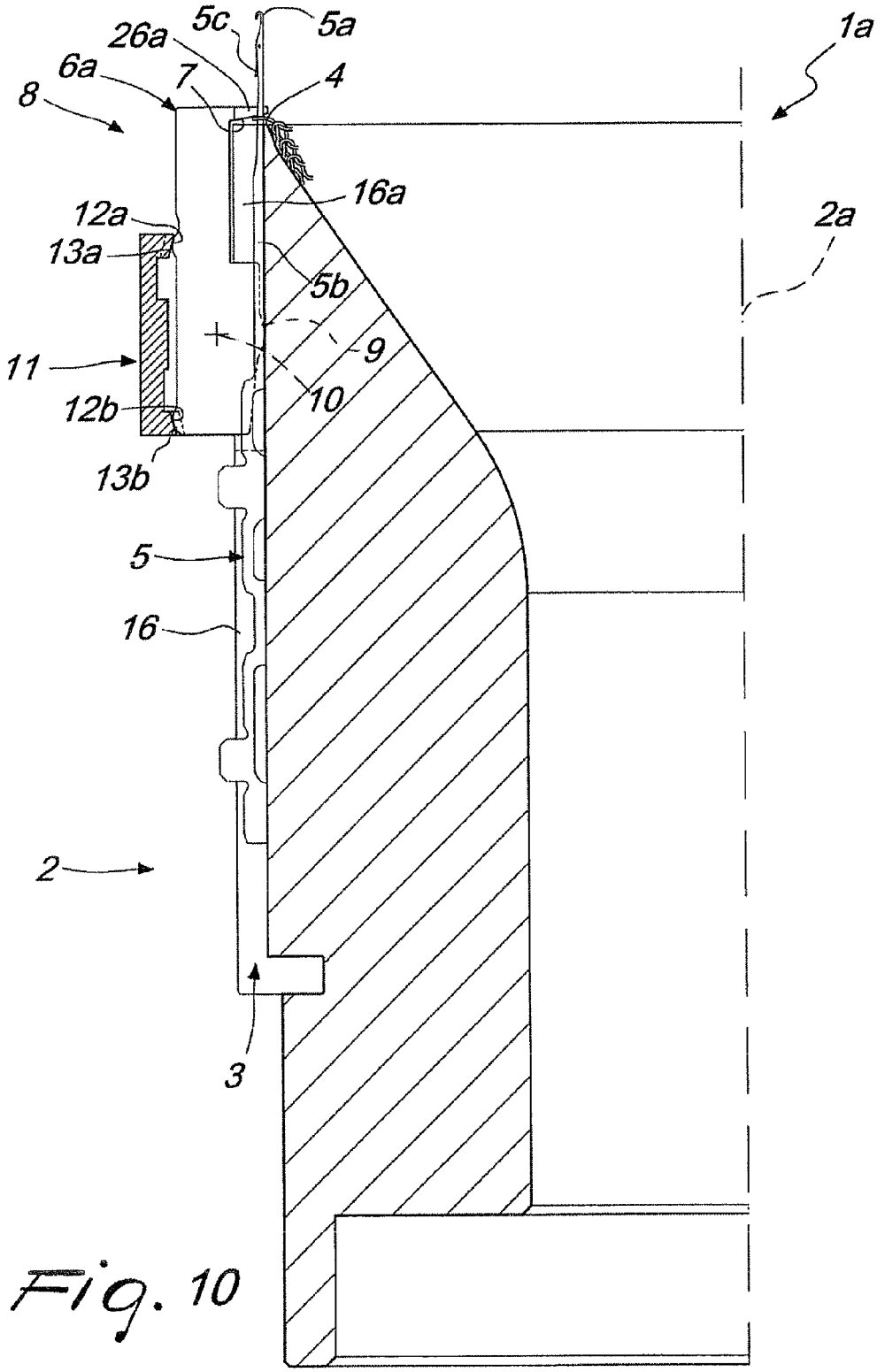
Figure 11:
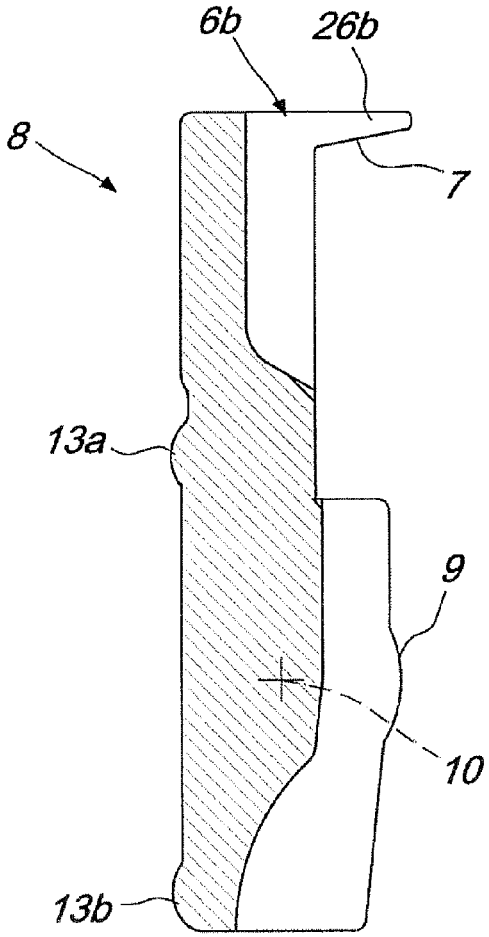
FIG. 11 is a sectional view of a knitting retainer composed of two laminar elements, taken in a manner similar to FIG. 3.
Figure 12:
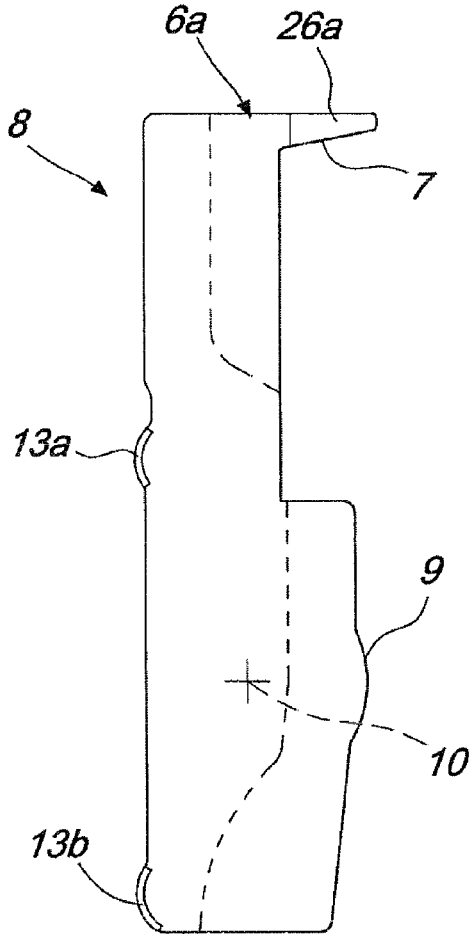
FIG. 12 is a side elevation view of a knitting retainer composed of two laminar elements.

After the needles 5 have retracted into the corresponding slot 3 of the needle holder 2, just before their extraction motion begins or at the beginning of the extraction motion of the needles 5, the knitting retainers 8, as a consequence of the action of the profile 12*a* of the actuation cam 11 on the region 13*a*, are moved into the second position so as to make the stop shoulder 7 face the knitting forming plane 4. In this position, the knitting retainers 8 form a sort of comb, which retains the loops of knitting carried by the needles 5, preventing them from following the needles 5 in their extraction motion. In this manner, the loops of knitting are retained proximate to the knitting forming plane 4, while the needles 5 move beyond, with their latch 5*c*, which is thus assuredly open, the loops of knitting retained by the knitting retainers 8, as shown in FIGS. 5 and 10.

Thanks to this fact, even in the presence of reduced or insufficient traction of the knitting, correct knitting formation is achieved, and in case of breakage of the yarn or yarns that feed the needles it is possible to achieve resumption of knitting without the need for manual intervention.

It should be noted that the knitting retainers 8, in their oscillating motion about the corresponding oscillation axes 10, are guided by the fins 16 and by the needles 5 themselves.

In practice it has been found that the machine according to the invention fully achieves the intended aim, since despite being provided without sinkers, due to the presence of the knitting retainers which can be adopted without problems even in the case of fine gauges, it ensures correct formation of knitting without thereby imposing a limitation of the active needles, thus allowing to utilize fully its productive potential.

The machine thus conceived is susceptible of numerous modifications and to variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2007A001098 from which this application claims priority are incorporated herein by reference.

The invention claimed is:

1. A knitting machine with latch needles, comprising a needle holder having on one face thereof a plurality of side-by-side slots which are open at one of their longitudinal ends on one side of the needle holder that defines the knitting forming plane, each slot accommodating a needle actuatable with reciprocating motion along the corresponding slot composed of extraction and retraction motion, the extraction motion for extracting the needle with its tip and with a portion of its shank from the needle holder through said longitudinal end of the corresponding slot in order to unload onto its shank the loop of knitting formed previously and/or to take up the yarn or yarns dispensed at a feed or drop of the machine, and the retracting motion for retracting the needle with its tip into the corresponding slot in order to form a new loop of knitting, lowering the previously formed loop of knitting to form knitting, further comprising knitting retainers, each of which has a body which is composed of at least two side-by-side laminar elements which are connected to each other, said at least two laminar elements of each knitting retainer being arranged in a same slot or in two contiguous slots of said slots, at least one of the laminar elements that compose a knitting retainer having a retention portion which forms a stop shoulder for the knitting, each knitting retainer being movable on command from a first position, in which the retainer does not interfere with the knitting being formed, to a second position, in which the retainer is inserted, with said retention portion, between two contiguous needles, in a region which faces said knitting forming plane, in order to retain the portion of knitting that lies between two contiguous needles, contrasting the transfer of the knitting along the needles during the extraction motion of said needles, actuation means being provided for actuating said knitting retainers for their transition from said first position to said second position and vice versa in a manner which is coordinated with the actuation of the contiguous needles.

2. The machine according to claim 1, wherein said two laminar elements of the knitting retainer are jointly connected to each other.

3. The machine according to claim 1, wherein each of said laminar elements lies on a plane which is parallel to the side walls of the slot in which it is arranged.

4. The machine according to claim 1, wherein each of said slots accommodates at least one laminar element of a knitting retainer.

5. The machine according to claim 1, wherein said retention portion is formed by a longitudinal end of at least one of the laminar elements that compose a knitting retainer, said retention portion protruding beyond said knitting forming plane and protruding toward the needle holder in order to form, with its side directed toward said knitting forming plane, said stop shoulder.

6. The machine according to claim 1, wherein each one of said laminar elements has its own retention portion which defines said stop shoulder for the knitting.

7. The machine according to claim 1, wherein each knitting retainer is composed of two laminar elements arranged in a same slot, laterally and on mutually opposite sides with respect to the needle accommodated within said slot, said knitting retainer being arranged so as to straddle the needle arranged within said slot.

8. The machine according to claim 1, wherein each knitting retainer is composed of two laminar elements arranged in two contiguous slots, laterally with respect to the needles accommodated in said two contiguous slots, said knitting retainer being arranged so as to straddle the portion of the needle holder that is arranged between two contiguous slots.

9. The machine according to claim 1, wherein the portions of the needle holder arranged between two contiguous slots have a reduced thickness at said laminar elements of the knitting retainers.

10. The machine according to claim 1, wherein each knitting retainer is connected at least to the contiguous knitting retainer that lies closest thereto, forming a single element composed of at least two knitting retainers.

11. The machine according to claim 1, wherein each knitting retainer can oscillate, on a plane which is substantially perpendicular to the face of the needle holder in which said slots are formed, in order to pass from said first position to said second position and vice versa.

12. The machine according to claim 1, wherein each of the laminar elements that compose said knitting retainer has an intermediate portion which rests against the bottom of the slot in which it is accommodated; said intermediate portion defining an axis for the oscillation of the laminar element with respect to the needle holder; said oscillation axis being oriented substantially at right angles to the plane of arrangement of the corresponding laminar element; said laminar element being able to oscillate, together with the at least one laminar element to which it is connected, about the corresponding oscillation axis with respect to said needle holder, for the transition of the knitting retainer from said first position to said second position or vice versa.

13. The machine according to claim 12, wherein said intermediate portion is shaped like a circular sector.

14. The machine according to claim 1, wherein said means for the actuation of said knitting retainer for its transition from said first position to said second position and vice versa comprise at least one actuation cam which faces the face of the needle holder in which said slots are formed; said needle holder being actuatable along an actuation direction which is substantially perpendicular to the longitudinal extension of said slots with respect to said at least one actuation cam and said at least one actuation cam having a profile which is adapted to act alternately on said knitting retainer, composed of at least two laminar elements, in two regions which are arranged on mutually opposite sides with respect to the oscillation axes of the laminar elements that compose said knitting retainer in order to produce their oscillation about the corresponding oscillation axis with respect to said needle holder in one direction or in the opposite direction for the transition of the knitting retainer from said first position to said second position or vice versa.

15. The machine according to claim 1, being a double-bed machine.

16. The machine according to claim 15, wherein the retention portions of two laminar elements which belong to a same knitting retainer or to two contiguous knitting retainers which protrude beyond the knitting forming plane and are arranged between two contiguous needles form between them, with the corresponding knitting retainer or retainers in said second position, a passage for a needle arranged in the other bed of the machine.

17. The machine according to claim 1, having a gauge substantially ranging from 32 to 60 needles per inch.

18. The machine according to claim 1, being a circular knitting machine, said needle holder being constituted by a cylinder with said slots formed on its lateral surface and oriented longitudinally and parallel to the axis of said cylinder.

19. A knitting retainer for a knitting machine with latch needles, comprising a body which is composed of at least two side-by-side laminar elements which are connected to each other, said at least two laminar elements of each knitting retainer being adapted to be arranged in a same slot or in two contiguous slots of said knitting machine, at least one of the laminar elements that compose a knitting retainer having a retention portion which forms a stop shoulder for the knitting, each knitting retainer being movable on command from a first position, in which the retainer does not interfere with the knitting being formed, to a second position, in which the retainer is inserted, with said retention portion, between two contiguous needles, in a region which faces a knitting forming plane, in order to retain the portion of knitting that lies between two contiguous needles, contrasting the transfer of the knitting along the needles during the extraction motion of said needles.

* * * * *